US006688734B1

(12) United States Patent
Liu

(10) Patent No.: US 6,688,734 B1
(45) Date of Patent: Feb. 10, 2004

(54) PULL HANDLE OF AN INK REFILL CYLINDER

(76) Inventor: Win-Yin Liu, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/263,719

(22) Filed: Oct. 4, 2002

(51) Int. Cl.[7] ..... B41J 2/175
(52) U.S. Cl. ..... 347/85
(58) Field of Search ..... 347/84, 85, 86, 347/87; 141/18, 21, 25; 295/341, 346, 352; 222/325, 523, 567; 53/467, 468

(56) References Cited

U.S. PATENT DOCUMENTS 5,400,573 A * 3/1995 Crystal et al. ..... 53/468
5,515,663 A * 5/1996 Allgeier, Sr. et al. ..... 53/467
5,673,072 A * 9/1997 Scheffelin ..... 347/85
6,213,597 B1 4/2001 Liu ..... 347/85
6,386,691 B1 5/2002 Liu ..... 347/85
6,390,613 B1 * 5/2002 Liu ..... 347/85

* cited by examiner

*Primary Examiner*—Anh T.N. Vo
(74) *Attorney, Agent, or Firm*—Troxell Law Office PLLC

(57) ABSTRACT

A pull handle of an ink refill cylinder, which includes two symmetrical rectangular frame members assembled together; one end of the rectangular frame member is furnished with a positioning groove and a positioning ring surface for fastening an outer cylinder of a refill assembly in place; a pull end of an ink cylinder filled with ink is mounted in a hollow space of the rectangular frame member of the pull handle; after the refill assembly is connected with the refill hole of the ink cartridge, put the index finger and the middle finer on the pull surfaces under the grip stud of the ink cylinder, while the thumb is put on the push top; then, pull the ink cylinder upwards so as to refill the ink cartridge easily by means of a vacuum force under a convection effect.

4 Claims, 9 Drawing Sheets

PULL HANDLE OF AN INK REFILL CYLINDER

BACKGROUND OF THE INVENTION

1. Field of the Invention

This invention relates to an ink refill assembly, and particularly to a pull handle of an ink refill cylinder.

2. Description of the Prior Art

In the conventional refill operation for an ink cartridge, a syringe with an injection needle is used; when the pull handle of the syringe is pulled, ink will be sucked into the cylinder thereof; then, an ink-injection needle of the syringe will be plugged into a refill hole of an ink cartridge, and then push the pull handle down so as to inject a suitable quantity of ink into the ink cartridge.

In a conventional ink refill assembly filed by the applicant of this U.S. Pat. No. 6,213,597B1, the refill assembly includes an outer cylinder and an ink cylinder mounted in the outer cylinder; one end of the outer cylinder has a pull lug, while other end thereof has an ink-injection nozzle to facilitate the ink cylinder to plug into the inside of the outer cylinder; the ink cylinder and the outer cylinder are in contact with each other by means of a ruble ring to prevent from leaking between the two cylinders. The upper part of the ink cylinder has a ring-flange portion. During refilling operation, one hand holds the outer cylinder of the refill assembly, and the thumb can push or pull the ring-flange portion; in that case, the refilling operation with a single hand would be hindered as a result of the user's hand having different size and the vacuum force in the refill assembly. During the commercialized period, the structure of the ink cylinder of the ink cartridge was modified several times, and it is necessary to used two hands to operate it, i.e., one hand holds the outer cylinder of the refill assembly, while other hand pulls the grip stud of the ink cylinder, and it is disclosed in U.S. Pat. No. 6,386,691 B1; in the aforesaid application, the refill assembly is substantially a medical syringe improved partially. A user can operate it as the same way of using a syringe to increase the inner pressure in the ink cartridge; after the refill assembly is removed from the ink cartridge, the refill hole thereof would have ink leaked out or sputtered out.

SUMMARY OF THE INVENTION

The prime object of the present invention is to provide a pull handle of an ink refill cylinder, in which the pull lug ring of the outer cylinder of the refill assembly is mounted in a positioning groove and a positioning ring surface furnished in the pull handle; the grip stud and two symmetrical pull surfaces on the outer end of the ink cylinder are extended in a rectangular hollow space of the pull handle; the index finger and the middle finger are put on the two pull surfaces of the ink cylinder, while the thumb is put on the push top of the pull handle; then, one hand can pull the ink cylinder to start refilling ink into the ink cartridge.

Another object of the present invention is to provide a pull handle of an ink refill cylinder, in which the pull handle includes two symmetrical rectangular frame members; one end thereof is furnished with clamp plates having a positioning groove end a positioning ring surface; the positioning groove is used for fastening a pull lug ring of the outer cylinder of the refill assembly; the positioning ring surface will be in close contact with the outer cylinder of the refill assembly. After the two symmetrical rectangular frame members are assembled together, the outer cylinder and the pull handle will also be assembled together into one piece firmly.

Still another object of the present invention is to provide a pull handle of an ink refill cylinder, in which the ink cylinder of the refill assembly is used for filling ink; both sides of the ink cylinder are furnished with flat surfaces respectively, and the tail end thereof has a grip stud, under which two curved surfaces are furnished to facilitate an index finger and a middle ginger to hold, while the thumb of a user is put on the push top of the pull handle so as to pull the ink cylinder to move.

A further object of the present invention is to provide a pull handle of an ink refill cylinder, in which the clamp plates of the two symmetrical rectangular frame members are furnished with a positioning groove and a positioning ring surface, and they are designed to fit in with the pull lug ring of the outer cylinder of the refilling assembly so as to have the outer cylinder of the refill assembly clamped between the positioning groove and the positioning ring surface of the two symmetrical rectangular frame members.

A still further object of the present invention is to provide a pull handle of an ink refill cylinder, in which the clamp plates of the two symmetrical rectangular frame members are furnished with a positioning groove and a positioning ring surface, and such groove and positioning ring surface are used to fit in with the pull lug ring of the outer cylinder of a medical syringe so as to have the outer cylinder of the syringe fastened between the positioning groove and the positioning ring surface of the two symmetrical rectangular frame members.

DETAILED DESCRIPTION OF THE PREFERRED EMBODIMENT

Figure 1:
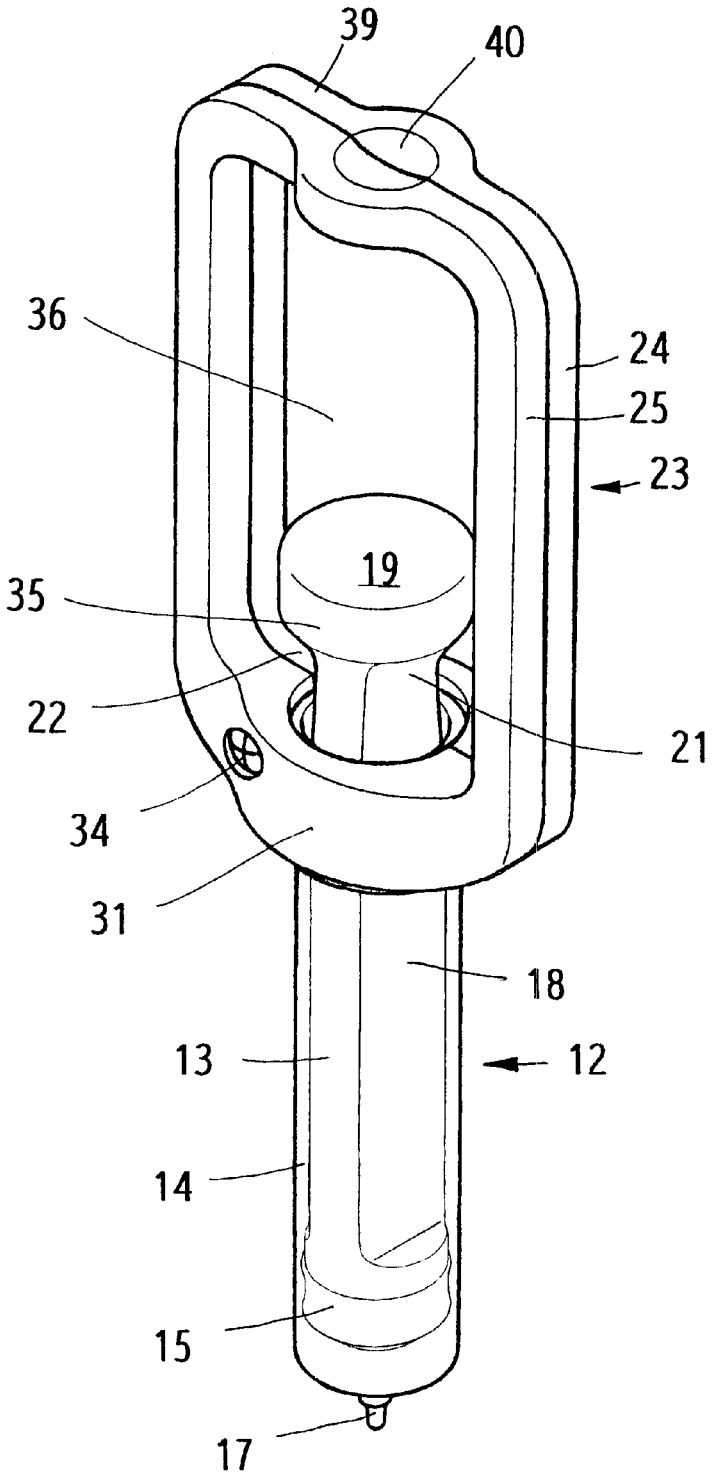
FIG. 1 is a perspective view of the present invention, showing a pull handle and a syringe assembled together.
Figure 2:
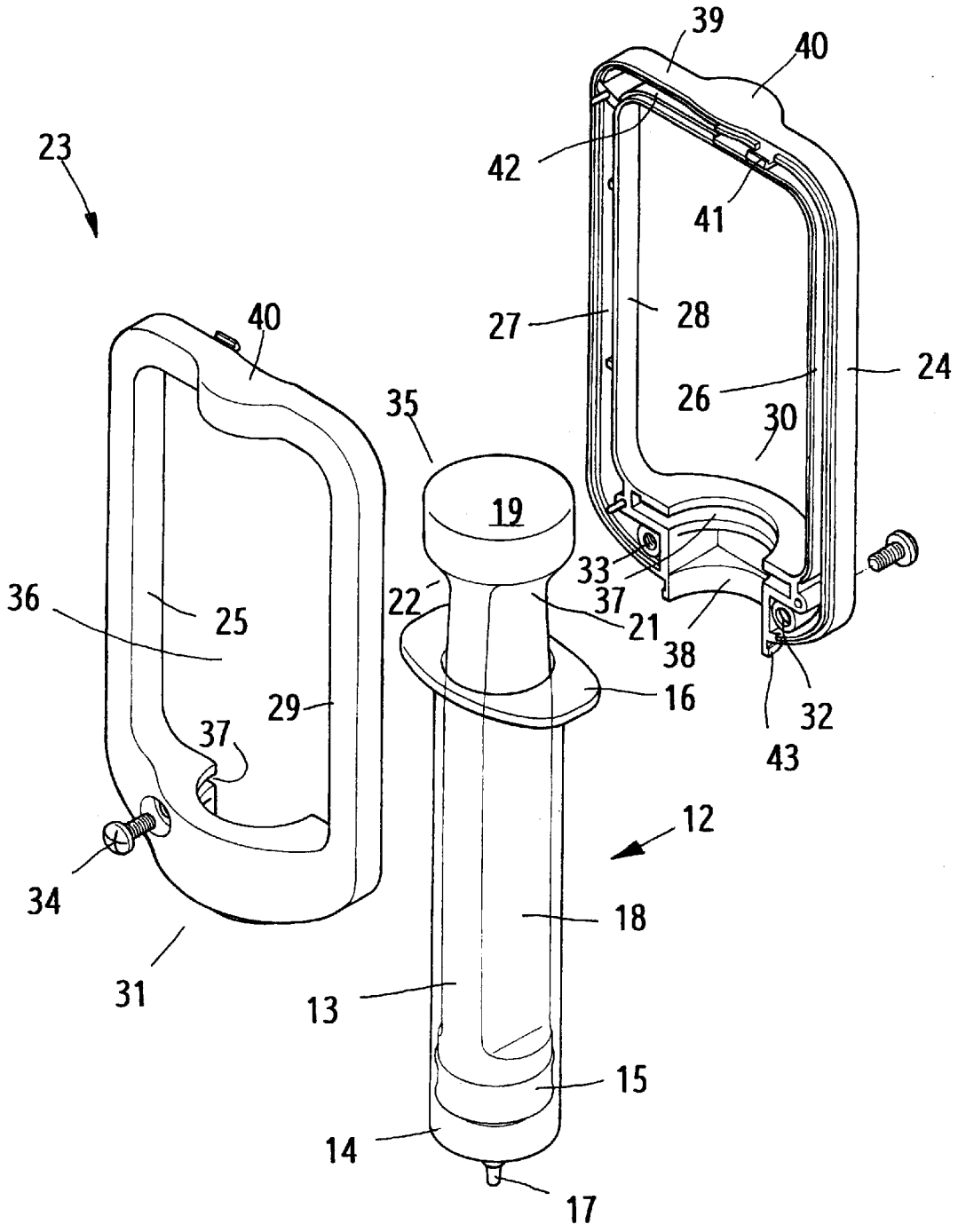
FIG. 2 is a disassembled view of the present invention.
Figure 3:
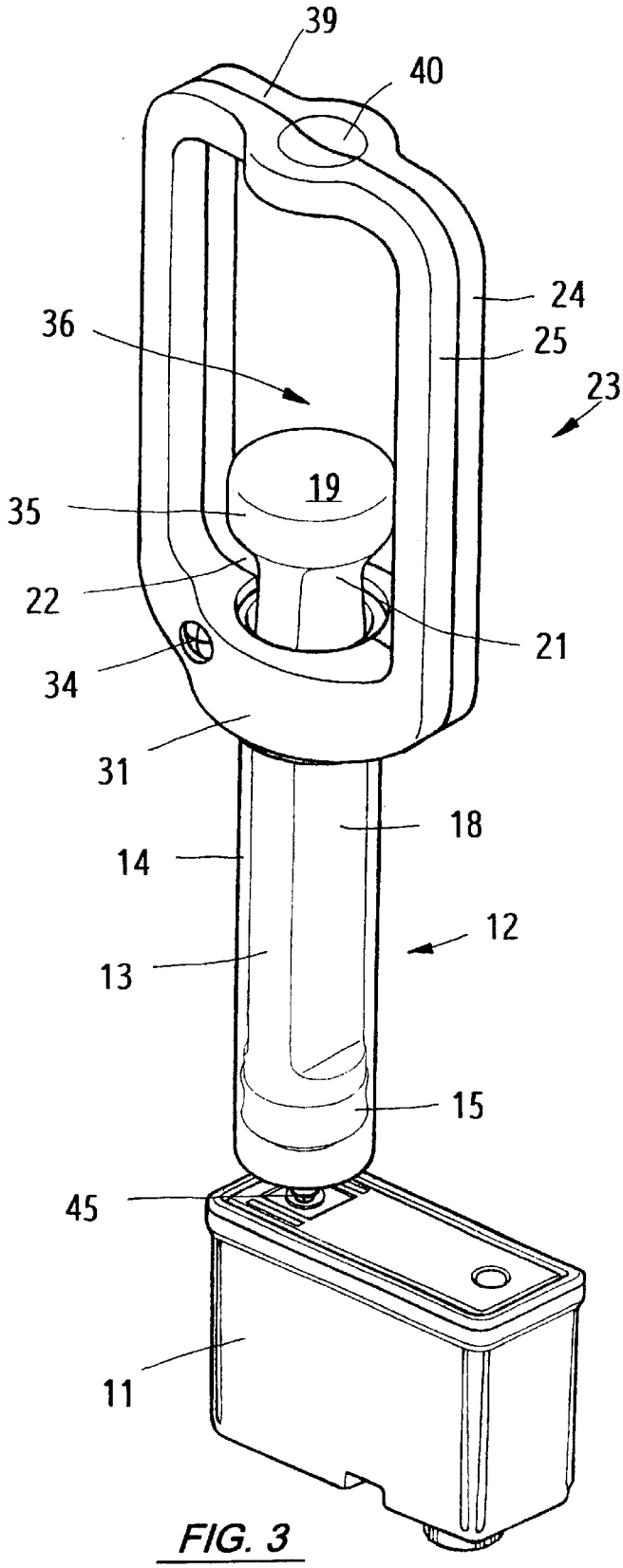
FIG. 3 is a perspective view of the present invention, showing the syringe and an ink cartridge connected together.
Figure 4:
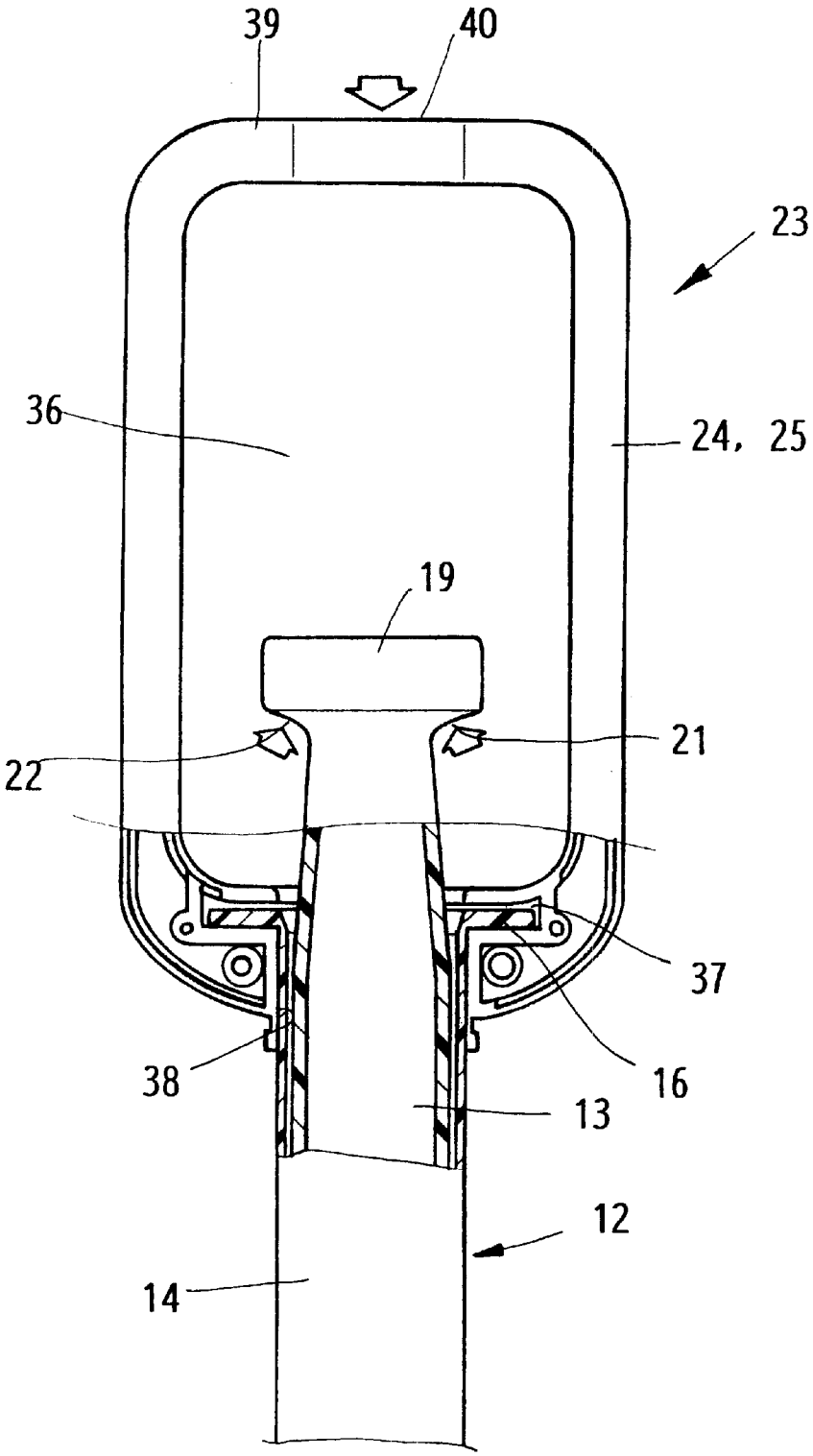
FIG. 4 is a sectional view of the present invention, showing he outer cylinder of the syringe and the pull surface of the ink cylinder.
Figure 5:
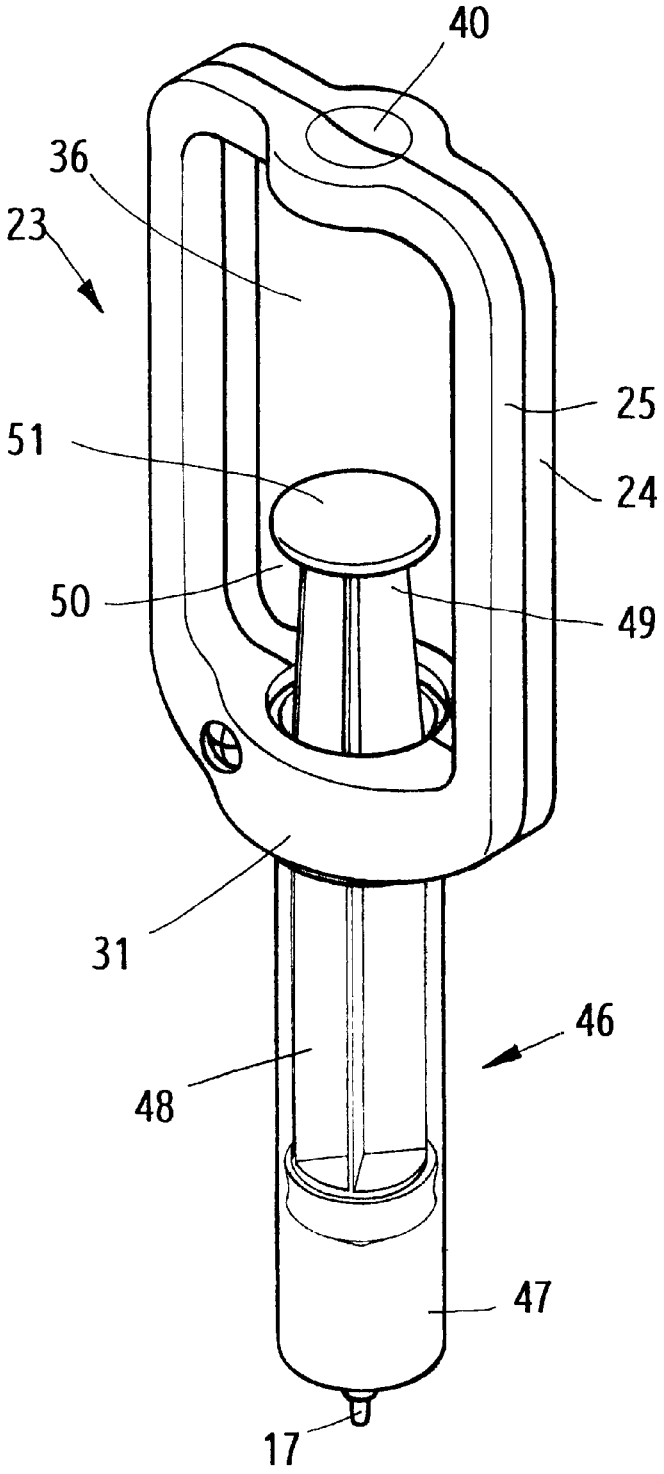
FIG. 5 is a perspective view of the present invention, showing the assembled structure between the pull handle and the syringe.
Figure 6:
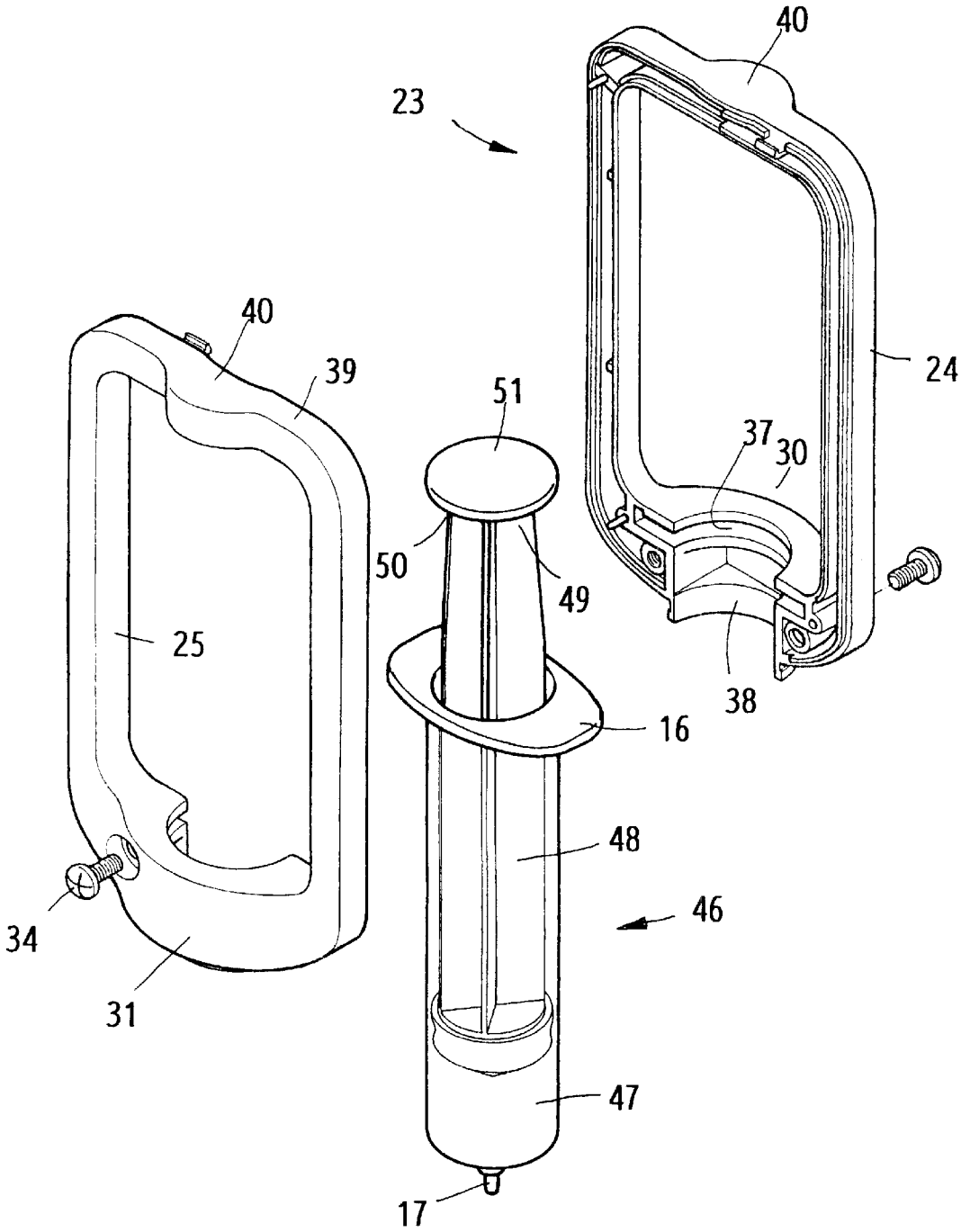
FIG. 6 is a disassembled view of the present invention.
Figure 7:
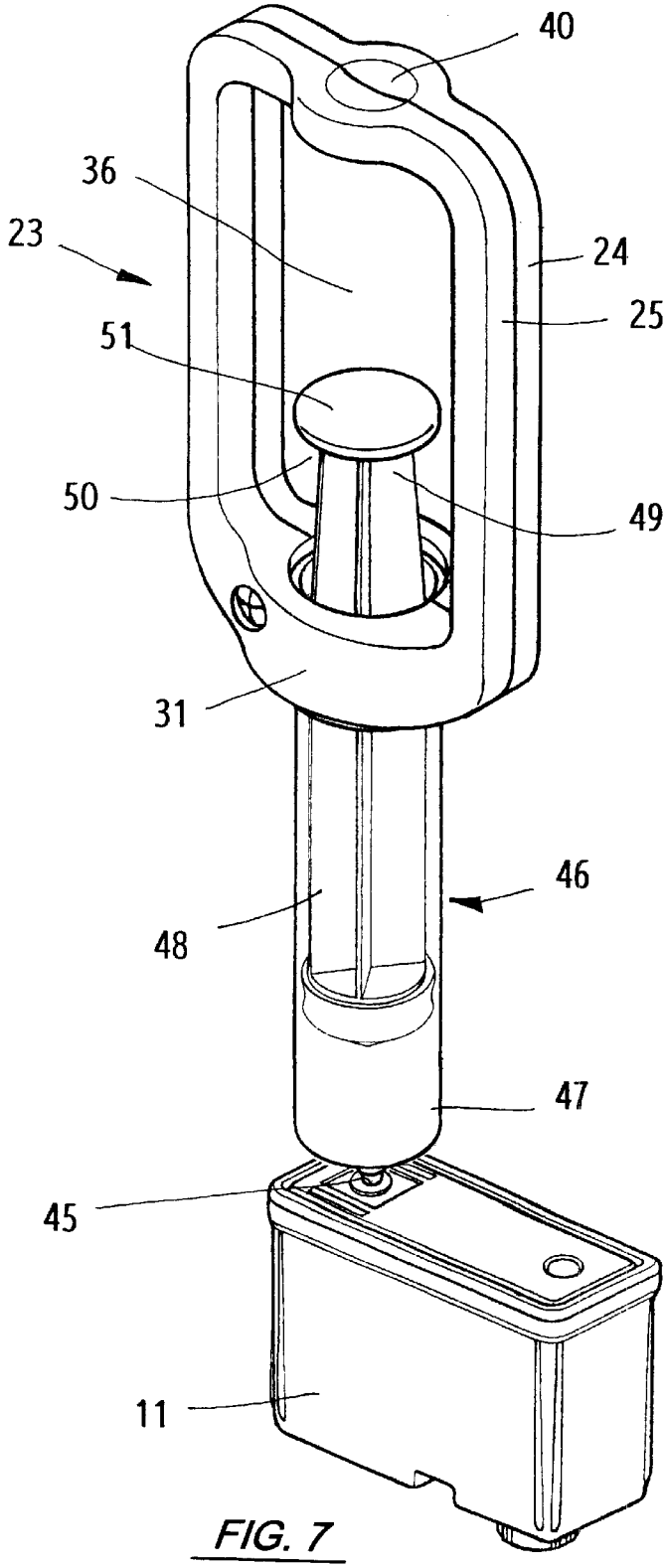
FIG. 7 is a perspective view of the present invention, showing the assembled structure between the syringe and the ink cartridge.
Figure 8:
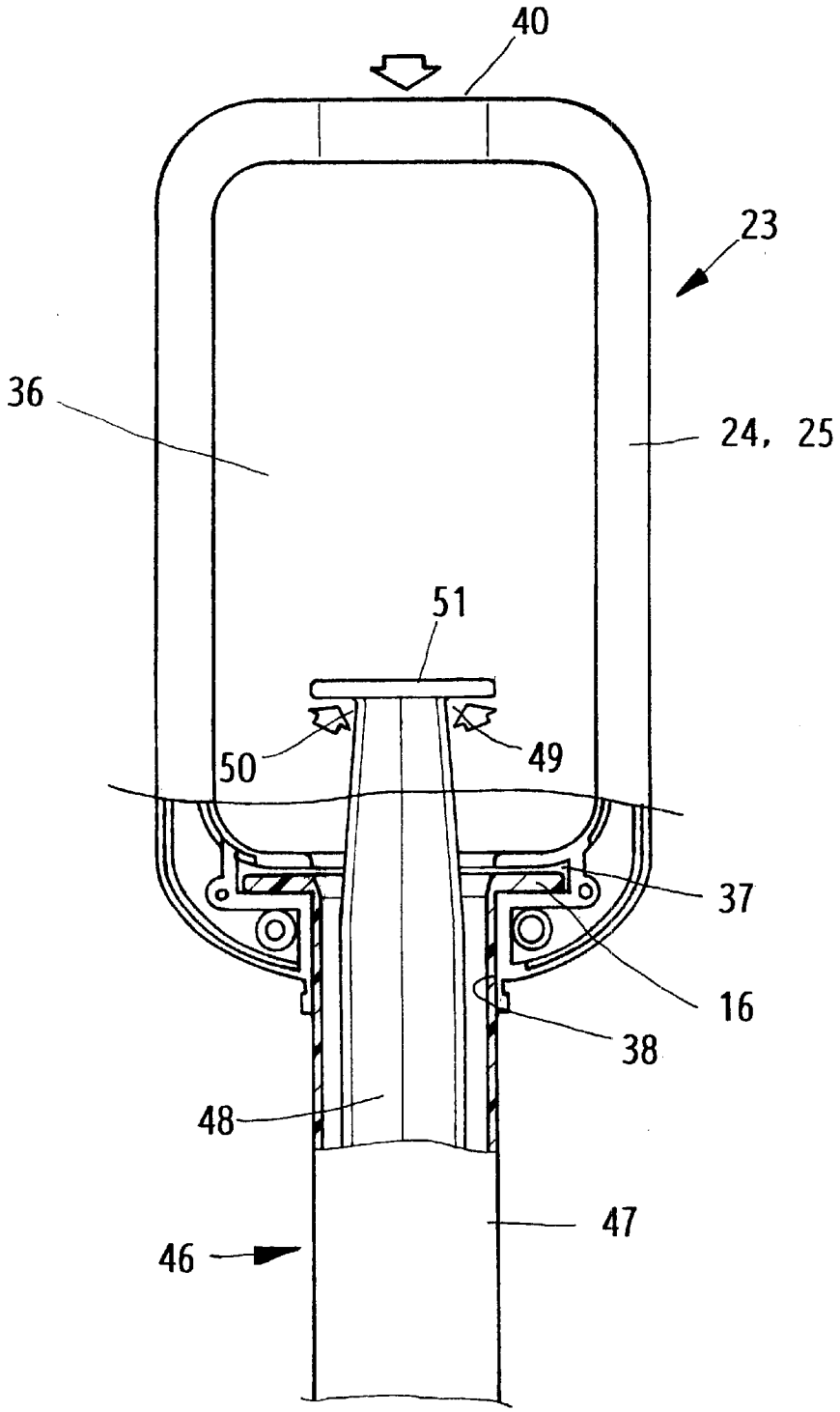
FIG. 8 is a sectional view of the present invention, showing the outer cylinder of the syringe and the pull surface of the piston rod.

This invention relates to a pull handle of an ink cylinder; as shown in FIGS. 1 to 3, the pull lug of the outer cylinder 14 and the pull lug ring 16 in the refill assembly 12 are mounted in the symmetrical frame members 24 and 25 which include two clamp plates 30 and 31 with grooves, and two positioning ring surfaces 37 and 38. The pull end 35 of the ink cylinder 13 extends into the hollow space 36 of the rectangular frame. After the refill nozzle 17 of the refill assembly 12 is connected with the refill hole 45 of the ink cartridge 11, the index finger and the middle finger of a person can be fitted on the two pull surfaces 21 and 22 under the pull end 35 of the ink cylinder 13; then, the thumb can be put on the push top 35 of the pull handle 23; after the index finger and the middle finger pull the ink cylinder 13 upwards, the hollow space therein will be increase, i. e., the air in the ink cartridge 11 will be drawn to the upper part of the ink cylinder 13; as soon as the fingers pulling the ink cylinder are released, the vacuum sucking force in the ink cartridge 11 will have the ink in the lower part of the refill assembly 12 sucked into he ink cartridge; repeat the aforesaid steps several times, and then the ink cartridge 11 will be refilled.

The refill assembly 12 includes an ink cylinder 13, an outer cylinder 14 and a rubber ring 15; the ink cartridge 13 has a hollow space; one end thereof is mounted with a rubber ring 15 and then the ink cylinder is mounted in the inner space of the outer cylinder 14; both sides of the bottle body 18 of the ink cylinder 13 are flat surfaces extended into two curved pull surfaces 21 and 22 under the grip stud 19. One end of the outer cylinder 14 of the refill assembly 12 is furnished with a pull lug ring 16, while other end thereof has an injection nozzle 17 to connect with a refill hole 45 of the ink cartridge 11. The ink cylinder 13 and the outer cylinder 14 are assembled together, and sealed from each other with a rubber ring 15; the ink cylinder 13 can be filled with a suitable quantity of ink, and the injection nozzle 17 should be sealed with a plug; the refill assembly 12 loaded with ink can be shipped freely.

Before the refill assembly 12 is mounted with the pull handle 23, the injection nozzle 17 of the refill assembly 12 should be connected together with the refill hole 45 of the ink cartridge 45. Use one hand to hold the outer cylinder 14 of the refill assembly 12, while the other handle holds the grip stud 19 of the ink cylinder 13 to pull the grip stud 19 upwards so as to suck the air in the ink cartridge 11 to the upper space of the ink cylinder 13; then, release the ink cylinder 13 so as to have the ink in the refill assembly 12 sucked into the ink cartridge 11 as a result of the ink cartridge 11 having a negative pressure; the aforesaid steps should be repeated several times so as to have the ink cartridge 11 refilled with ink.

Figure 9:
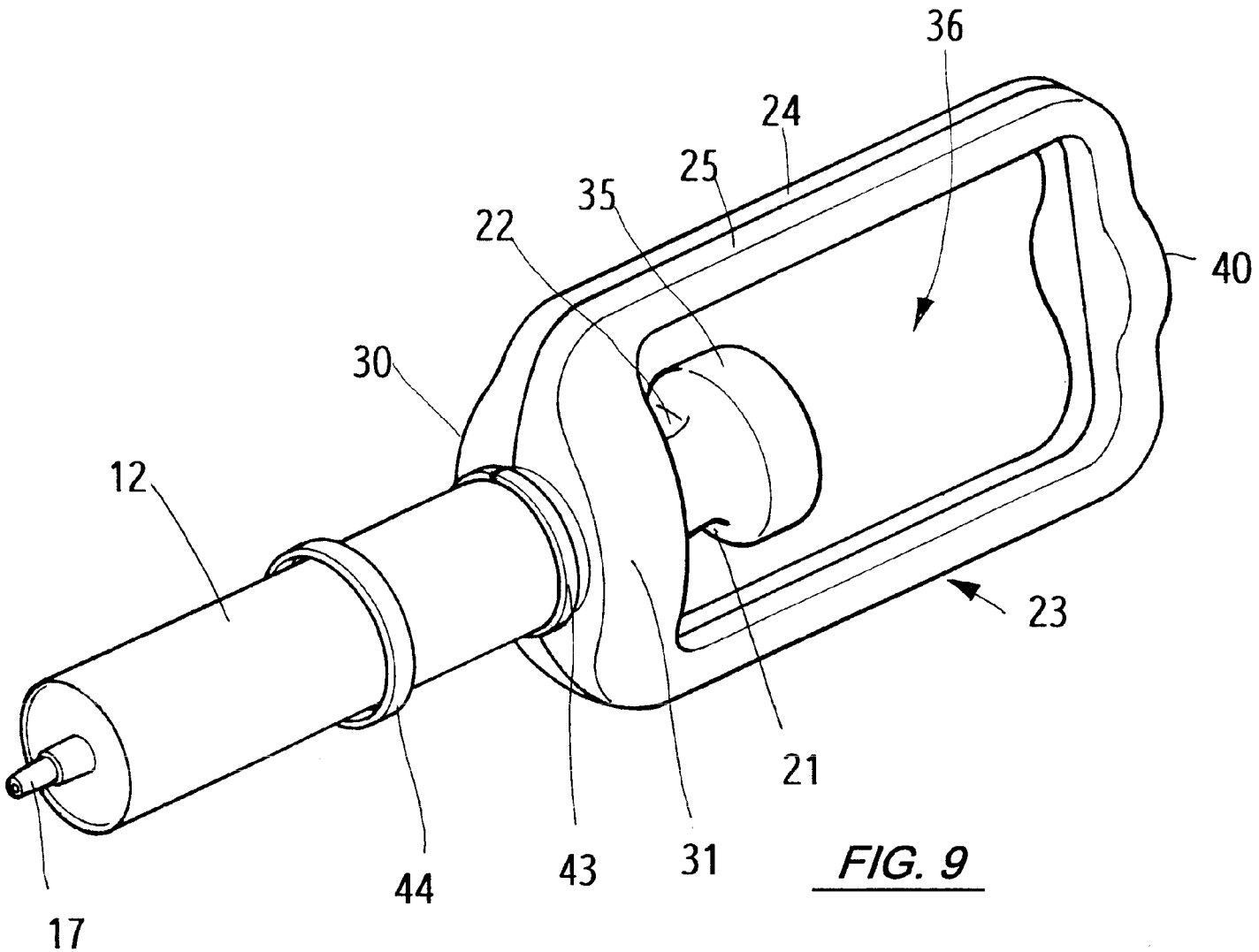
FIG. 9 is a disassembled view of the present invention, showing the pull handle fastened in place with a ring sleeve.

In order to refill the ink cartridge 11 with a single hand upon pulling the refill assembly 12, the refill assembly 12 and the pull handle 23 must be assembled together first; the pull handle 23 includes two symmetrical rectangular frame members 24 and 25 and some other fastening parts. The inner edges of the frame plates 28 and 29 of the symmetrical rectangular frame members 24 and 25 are furnished with positioning flange 26 and positioning groove 27 respectively. The upper part of the frame plate 39 is furnished with a hook 41 and a hook groove 42, and the lower parts of the clamp plates 30 and 31 are furnished with positioning groove 37 and positioning ring surface 38 respectively. The two symmetrical rectangular frame members 24 and 25 are assembled together by means of the hook 41 and the hook groove 42 of the frame plate 39, and by means of the corresponding positioning flange 26 and positioning groove 27 in the frame plates 28 and 29 so as to provide a steady guide and connection; then, the two corresponding clamp plates 30 and 31 are assembled and fastened together with screws 34 or ring sleeve 44 (as shown n FIG. 9); then, the two symmetrical rectangular frame members 24 and 25 are assembled into a rectangular pull handle 23.

Before the two rectangular frame member 24 and 25 of the pull handle 23 are assembled together, the pull lug ring 16 of the outer cylinder 14 must be mounted in the positioning grooves 37 of the clamp plates 30 and 31 in the lower parts of the frame members 24 and 25; the outer edge of the positioning grooves 37 has a positioning ring surface 38, which is designed in a form to fit the shape of the outer cylinder 14. When the outer cylinder 14 is mounted in the frame member 24, the pull lug ring 16 of the outer cylinder 14 should be mounted in the positioning groove 37 of the clamp plate 30 so as to have the outer cylinder 14 contacted closely with the positioning ring surface 38; the two symmetrical rectangular frame members 24 and 25 of the pull handle 23 should be assembled together oppositely. After the clamp plates 30 and 31 of the two symmetrical frame members 24 and 25 are assembled together, the pull lug ring 16 and the inner surface of the outer cylinder 14 will be fastened together by means of screws 34 or a ring sleeve 44; in that case, the refill assembly 12 and the rectangular pull handle 23 will be assembled together as one piece.

After the pull lug ring 16 of the outer cylinder 14 of the refill assembly 12 is assembled together with the pull handle 23, the pull end 35 of the ink cylinder 13 extends into the hollow space 36 of the rectangular pull handle 23. Two symmetrical pull surfaces 21 and 22 are formed by means of the grip stud 19 of the pull end 35 of the ink cylinder 13 and both sides of the bottle body 18. The two symmetrical pull surfaces 21 and 22 are just able to have the index finger and the middle finger fitted therein. As soon as the thumb of a person pushes the push top 40 of the pull handle 23, the index finger and the middle finger will pull the grip stud 19 of the ink cylinder 13 to move.

Before refilling ink into the ink cartridge 11, the hollow space of the ink cylinder 13 of the refill assembly 12 has already filled with ink; the refill nozzle 17 is sealed with a rubber plug. The refill assembly 12 and the rectangular pull handle 23 are assembled together as one piece. After the rubber plug of the injection nozzle 17 of the refill assembly 12 is removed, and then, the injection nozzle 17 is connected with the refill hole 45 of the ink cartridge 11; then the index finger and the middle finger are put to the symmetrical pull surfaces 21 and 22 under the grip stud 19 of the ink cylinder 13 respectively, while the thumb is put on the push top 40 of the pull handle 23 so as to facilitate the index finger and the middle finger to pull the ink cylinder 13, and to have the hollow space of the refill assembly 12 had more suck force in order to have the ink cartridge 11 sucked air therein so as to have the hollow space of the ink cartridge 11 yielded a negative pressure, As soon as the ink cylinder 13 is released, the ink cylinder 13 will be sucked back to its original position as a result of the negative pressure of the ink cartridge 11; in that case, the ink with a greater specific gravity will be sucked into the ink cartridge 11. The refill operation can be done for the ink cartridge 11 after repeating the aforesaid steps several times.

The positioning groove 37 and the positioning ring surface 38 furnished in the rectangular frame members 24 and 25 of the pull handle 23 are used for mounting the refill assembly 12; in addition, the positioning groove 37 and the positioning ring surface 38 in the clamp plates 30 and 31 of the rectangular frame members 24 and 25, as shown in FIGS. 5 to 8, can also be used for fitting a conventional pull lug ring 16 therein. After the two rectangular frame members 24 and 25 and a conventional syringe 46 are assembled together, an ink refill assembly 12 will be completed.

After the pull lug ring 16 of the syringe 46 and the pull handle 23 are assembled together, a disk member 51 on one end of the piston rod 48 will extend in the hollow space 36 of the pull handle 23; a cross-shaped rib is furnished under the disk member 51. The space between two ribs forms a pull surface 49 or 50 for receiving an index finger or a middle finger. The ink is first sucked into the inner space of the syringe 46; after the injection nozzle 17 and the refill hole 45 of the ink cartridge 11 are connected together; the index finger and the middle finger are put to the put surfaces 49 and 50 of the piston rod 48 respectively, while the thumb is put on the push top 40 of the pull handle 23; then, the index finger and the middle finger can pull the piston rod 48 to move, and then release the piston rod after several seconds; repeat the aforesaid operation steps several times, the ink cartridge 11 will be refilled completely.

In the present invention, the rectangular frame members 24 and 25 of the pull handle 23 are used for clamping the pull lug ring 16 of a refill assembly 12 or a syringe 46 so as to facilitate the refill assembly 12 or a syringe 46 to refill ink by means of a single hand; according to present invention, the refilling operation would not cause ink to leak out as using a conventional syringe.

What is claimed is:

1. A pull handle of an ink refill cylinder comprising:

a refill assembly, of which one end of an outer cylinder furnished with a pull lug ring, and said pull lug ring assembled together with a positioning groove and a positioning ring surface of said pull handle; a pull end of an ink cylinder having a grip stud, and both sides of said grip stud furnished with two symmetrical pull surfaces respectively; a given space furnished between said pull surfaces and frame surface of said pull handle so as to facilitate an index finger and a middle finger to put in;

said pull handle which includes two symmetrical rectangular frame members;

an inside of clamp plates of said frame members furnished with the positioning groove and the positioning ring surface for receiving said pull lug ring of the outer cylinder; after said two rectangular frame members being assembled together, said pull lug ring being fastening between said two rectangular frame members, and then said grip stud on a pull end of said ink refill cylinder being extended in a rectangular hollow space of said pull handle.

2. The pull handle of an ink refill cylinder as claimed in claim 1, wherein both sides of said frame plates of two symmetrical rectangular frame members of said pull handle are furnished with a positioning flange and a positioning groove respectively; upper parts of said frame plates furnished with a hook and hook groove respectively.

3. The pull handle of an ink refill cylinder as claimed in claim 1, wherein said two symmetrical rectangular frame members of said pull handle are assembled together, and upper parts of said frame plates furnished with a wide push top.

4. The pull handle of an ink refill cylinder as claimed in claim 1, wherein an inner edge of said clamp plates of said frame members of said pull handle are furnished with the positioning groove and the positioning ring surface, and the pull lug ring on said outer cylinder of ink refill cylinder syringe being mounted therein; after said two rectangular frame members being assembled together, said pull lug ring being fastened between said two rectangular frame members; then, end of said ink cylinder of said ink refill cylinder extended in an rectangular hollow space.

* * * * *